US006442947B1

(12) United States Patent
Mitchell

(10) Patent No.: US 6,442,947 B1
(45) Date of Patent: Sep. 3, 2002

(54) DOUBLE INLET ARRANGEMENT FOR PULSE TUBE REFRIGERATOR WITH VORTEX HEAT EXCHANGER

(76) Inventor: Matthew P. Mitchell, 151 Alvarado Rd., Berkeley, CA (US) 94705

( * ) Notice: Subject to any disclaimer, the term of this patent is extended or adjusted under 35 U.S.C. 154(b) by 0 days.

(21) Appl. No.: 09/903,305

(22) Filed: Jul. 10, 2001

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS

| | | | | |
|---|---|---|---|---|
| 3,521,657 A | | 7/1970 | Ayers | |
| 5,335,505 A | | 8/1994 | Ohtani | |
| 5,642,623 A | | 7/1997 | Hiresaki | |
| 5,701,743 A | | 12/1997 | Hagiwara | |
| 5,966,942 A | * | 10/1999 | Mitchell | 62/6 |
| 5,966,943 A | * | 10/1999 | Mitchell | 62/6 |
| 6,109,041 A | | 8/2000 | Mitchell | |

OTHER PUBLICATIONS

P.E. Bradley et al., "Design and Test of the NIST/Lockheed Martin Miniature Pulse Tube Flight Cryocooler", Cryocoolers 11, 2001, pp. 189–198, Fig. 1, p. 191, Kluwer Academic/Plenum Publishers, New York, USA.

J.M. Poncet et al., "Developmenst on Single and Double Stage GM Type Pulse Tube Cryorefrigerators", Cryocoolers 11, 2001, pp. 229–233, esp. p. 229, Kluwer Academic/Plenum Publishers, New York, USA.

S. Fujimoto et al., "Experimental Investigation of Some Phase Shifting Types on Two–Stage GM Pulse Tube Cryocooler", Advances in Cryogenic Engineering, 2000, pp. 127–133, esp. pp. 127–131 and Figs. 2, 5, vol. 45A, Kluwer Academic/Plenum Publishers, New York, USA.

L. Duband, "Experimental Results on Inertance and Permanent Flow in Pulse Tube Coolers", Cryocoolers 10, 1999, pp. 281–290, esp. p. 282, Fig. 1, Kluwer Academic/Plenum Publishers, New York, USA.

V. Kotsubo et al., "Observation of DC Flows in a Double Inlet Pulse Tube", Cryocoolers 10, 1999, pp. 299–305, Kluwer Academic/Plenum Publishers, New York, USA.

ARTX, "Compressed Air Productivity Tools", 1994, pp. 4–6, ARTX, Fairfield, Ohio, USA.

* cited by examiner

*Primary Examiner*—Ronald Capossela

(57) ABSTRACT

A double inlet passage 70 connects a compressor 40 to remote end 53 of a vortex tube 51 that serves as the heat-rejecting heat exchanger of an orifice pulse tube refrigerator. Double inlet passage 70 includes means 3 for controlling DC flow in that passage. Fluid flows between compressor and reservoir enhance heat-rejecting effectiveness of vortex tube 51.

6 Claims, 4 Drawing Sheets

DOUBLE INLET ARRANGEMENT FOR PULSE TUBE REFRIGERATOR WITH VORTEX HEAT EXCHANGER

GOVERNMENT RIGHTS

The invention was made with Government support under contract F29601-99-C-0171 awarded by the United States Air Force. The Government has certain rights in the invention.

BACKGROUND

1. Field of Invention

This invention relates to orifice pulse tube refrigerators and, in particular, to orifice pulse tube refrigerators that employ a vortex tube as the heat-rejecting heat exchanger at the warm end of the pulse tube.

2. Description of Prior Art

In the prior art double inlet arrangement for an orifice pulse tube refrigerator, a compressor is connected to the refrigerator in two places. One connection, through which flow is unrestricted, cyclically forces fluid into and withdraws fluid out of the regenerator, as shown in FIG. 1. The other connection, the "double inlet passage", is a restricted channel through which the compressor cyclically forces and withdraws a limited quantity of fluid. Heat exchangers and a pulse tube complete a loop between the two points at which the compressor is connected to the refrigerator.

The double inlet passage is connected to the warm end of the prior art pulse tube between the warm heat exchanger and the orifice that connects the warm heat exchanger to a reservoir. Fluidic devices in the double inlet passage connecting the compressor to the warm end of the pulse tube have been employed to control the direct current flow (hereinafter "DC flow") that would otherwise occur when the compressor is connected to the pulse tube at both ends through two separate passages. Experience has shown that some DC flow may be desirable under some conditions. A fluidic device such as a vortex diode, directional jet, or Tesla diode can bias the flow in the double inlet passage so that optimal net DC flow can be obtained as fluid passes back and forth between the compressor and pulse tube.

The purpose of incorporating a double inlet passage at the warm end of an orifice pulse tube refrigerator is to alter the phase of flows in the cold end of the pulse tube relative to pressure. Bleeding some fluid through the double inlet passage to the warm end of the pulse tube as pressure is rising tends to retard the entrance of fluid from the cold heat exchanger into the pulse tube until pressure is high. Then, when fluid emerges from the cold heat exchanger into the pulse tube, it is not adiabatically heated as the pressure rises. It can then be adiabatically cooled, as pressure falls, to a lower temperature than could be obtained if the fluid had first been heated to a higher temperature in the pulse tube.

As pressure is falling, the double inlet bleeds some fluid from the warm end of the pulse tube, retarding the flow of cold fluid back into the cold heat exchanger, and permitting the fluid to cool adiabatically for a longer time, and to a lower temperature, than would otherwise be possible, before passing through the cold heat exchanger.

The amount of fluid that flows back and forth in the pulse tube of a pulse tube refrigerator is limited by the volume of the pulse tube. That is, some fluid must remain in the pulse tube at all times. While some fluid moves back and forth between the cold end of the pulse tube and the cold heat exchanger and some fluid moves back and forth between the warm end of the pulse tube and the warm heat exchanger, a substantial quantity of fluid in the middle of the pulse tube must simply move back and forth in the pulse tube. As a consequence, the volume of fluid that passes from the warm end of the pulse tube to the reservoir and back again must be limited to a fraction of the volume of the pulse tube, of the order of ⅓ of that volume, or less. The flow back and forth in the double inlet passage is typically smaller than the flow between pulse tube and reservoir.

The concept of a "blind" vortex tube as heat-rejecting heat exchanger at the warm end of a pulse tube refrigerator has been patented (U.S. Pat. No. 6,109,041), incorporated herein by reference, as have a variety of related vortex devices (U.S. Pat. No. 5,966,942), also incorporated herein by reference. However, none of those vortex devices has connected the warm end of a vortex tube to the compressor of an orifice pulse tube refrigerator through a channel that bypasses the regenerator. None of those prior art vortex devices has described a double inlet passage of any kind.

Although prior art vortex devices have advantages as heat-rejecting heat exchangers at the warm end of a pulse tube refrigerator, all such devices heretofore proposed have been subject to the same flow limitations as conventional heat exchangers employed at the warm end of a pulse tube, thereby limiting their effectiveness.

SUMMARY

In accordance with the present invention, an orifice pulse tube refrigerator comprises a compressor, regenerator, cold heat exchanger, pulse tube, cold throat, vortex tube, vortex generator, reservoir connected to the vortex tube through the vortex generator, double-inlet passage connected between the remote end of the vortex tube and the compressor and means for controlling DC flow through the double-inlet passage. In operation, fluid flows into and out of the vortex tube through the small end of a cold throat, through a vortex generator located between vortex tube and reservoir, and through a double inlet passage that connects the remote end of the vortex tube to the compressor through diode.

Thus, all passages between the vortex tube and the other volumes to which it is connected are restricted. Flows through the three passages are controlled by the restrictive components peculiar to their location, but flows through each such restrictive component are also affected by the flows permitted by the other components. Thus, the flow back and forth through the cold throat is affected by the size of the cold throat opening, but also by the momentary differences between pressure in the pulse tube and pressure in the vortex tube.

The momentary pressure in the vortex tube is, in turn, affected by flows of fluid back and forth through the double inlet passage and flows to and from the reservoir. The limitation on flows back and forth through the cold throat remains; no more than a fraction of the fluid in the pulse tube may be permitted to pass back and forth through the cold throat. However, no such limitation is imposed upon the flows back and forth through the double inlet passage, or through the vortex generator. Thus, the combined flow from the pulse tube and the double inlet passage through the vortex tube and vortex generator to the reservoir may exceed the total volume of the pulse tube. That is not achievable with prior art orifice pulse tube refrigerators. With such relatively large flows back and forth through the vortex generator, the vortex tube is particularly effective, since much of the heat developed in the vortex tube can be rejected back to the compressor through the double inlet passage. Rejection of heat at the warm end of the pulse tube, in turn, is the basis of the cooling effect at the cold end of the pulse tube.

To achieve that effect, all openings to the vortex tube are calibrated relative to each other so as to permit optimum fluid flows through the cold throat relative to the volume of the pulse tube, optimum flows between the remote end of the vortex tube (where the double inlet passage is connected) to the reservoir, and optimum DC flow through the double inlet passage. When those adjustments have been made, the vortex tube functions as a more effective warm heat exchanger than any prior art alternative because it returns fluid through the cold throat to the pulse tube at a lower temperature than can be achieved by any other means.

OBJECTS AND ADVANTAGES

Accordingly, besides the objects and advantages of orifice pulse tube refrigerators in general and orifice pulse tube refrigerators equipped with vortex devices as warm heat exchangers, several objects and advantages of the present invention are:

(a) to provide a heat-rejecting heat exchanger with superior heat-rejecting capacity;

(b) to provide a heat rejecting heat exchanger that is easily fabricated at low cost;

(c) to provide a heat-rejecting heat exchanger that allows optimum adjustment of flows through a double inlet passage;

(d) to provide a double inlet arrangement that removes larger amounts of heat from the heat-rejecting heat exchanger than would otherwise be possible;

(e) to provide an orifice pulse tube refrigerator with a heat-rejecting heat exchanger that is simple, sturdy and reliable;

(f) to provide a vortex tube heat rejecting heat exchanger that can receive, and reject heat from, a volume of fluid greater than that which can be permitted to move into and out of the pulse tube of an orifice pulse tube refrigerator.

DRAWING FIGURES

Figure 1:
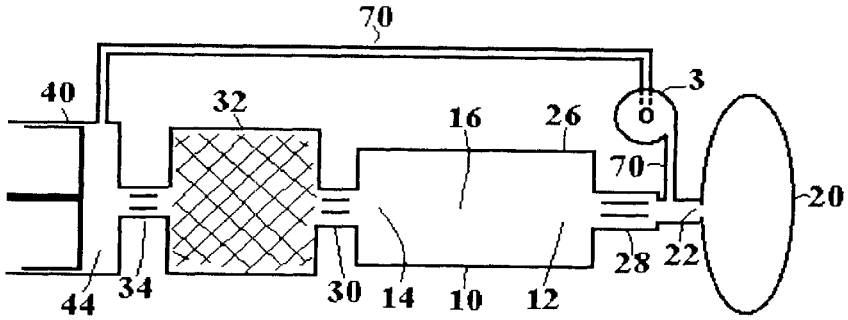
Fig. 1 Prior Art
FIG. 1 is a schematic representation of a prior art pulse tube refrigerator with a double inlet passage.

REFERENCE NUMERALS IN DRAWING FIGS.

3 diode
10 pulse tube
12 warn fluid
14 cold fluid
16 plug of stratified fluid
18 cold throat
20 reservoir
22 orifice
26 warm end of pulse tube
28 warm heat exchanger
30 cold heat exchanger
32 regenerator
34 aftercooler
40 compressor
44 compression space
50 blind vortex tube
51 vortex tube
52 vortex generator
53 remote end
54 inner rotating core of fluid
56 outer rotating shell of fluid
60 cover plate
62 tangential passage
64 race
66 axial passage
68 base
70 double inlet passage

DEFINITIONS

As used herein, "aftercooler" means a heat exchanger included in or attached to a compressor to remove heat of compression. "Connected" means arranged in such a way as to allow fluid to pass between connected components. "Cold throat" means a tapered passage that may have a straight conical taper or that may have a taper with bell-shaped, tulip-shaped or similar cross section. "Vortex generator" means one or more passages that enter an end of a vortex tube tangentially.

DESCRIPTION OF DRAWING FIGURES

FIGS. 1, 2, 3—PRIOR ART

FIG. 1 is a schematic representation of a prior art pulse tube refrigerator in which a fluid, typically helium, is moved into and out of aftercooler 34 and double inlet passage 70 by action of compressor 40, in which the pressure in compression space 44 is varied cyclically by action of compressor 40. The remaining components of the refrigerator are all in fluid communication with each other. Regenerator 32 is connected to pulse tube 10 through cold heat exchanger 30. Warm end 26 of pulse tube 10 is, in turn, connected to warm heat exchanger 28, which is in turn connected to both double inlet passage 70 and to reservoir 20. Orifice 22 constricts the passage between warm heat exchanger 28 and reservoir 20. Diode 3 is interposed in double inlet passage 70. As illustrated in FIG. 1, diode 3 is installed so as to encourage flow from compressor 40 to a point of interconnection between warm heat exchanger 28 and orifice 22 relative to flow in the opposite direction.

Figure 2:
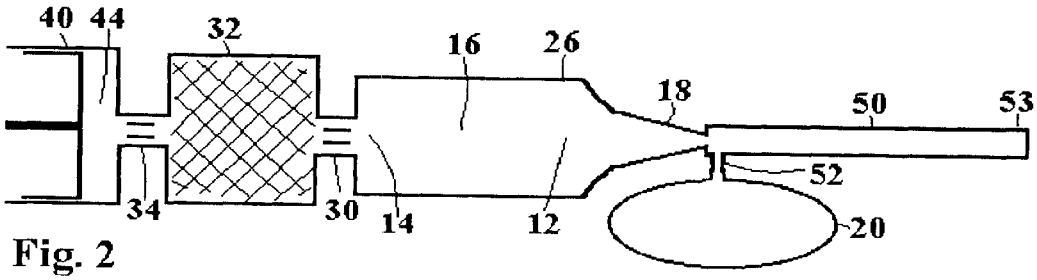
Fig. 2 Prior Art
FIG. 2 is a schematic representation of a prior art pulse tube refrigerator with a blind vortex tube as warm heat exchanger.

FIG. 2 is a schematic representation of a prior art pulse tube refrigerator generally similar to the prior art pulse tube refrigerator of FIG. 1 except that it employs blind vortex tube 50 as warm heat exchanger and lacks double inlet passage 70 and diode 3. In the refrigerator illustrated in FIG. 2, warm heat exchanger 28 of FIG. 1 is replaced by blind vortex tube 50 and orifice 22 is replaced by cold throat 18, by blind vortex tube 50 and by vortex generator 52 in combination with each other. Remote end 53 of blind vortex tube 50 is closed.

Figure 3:
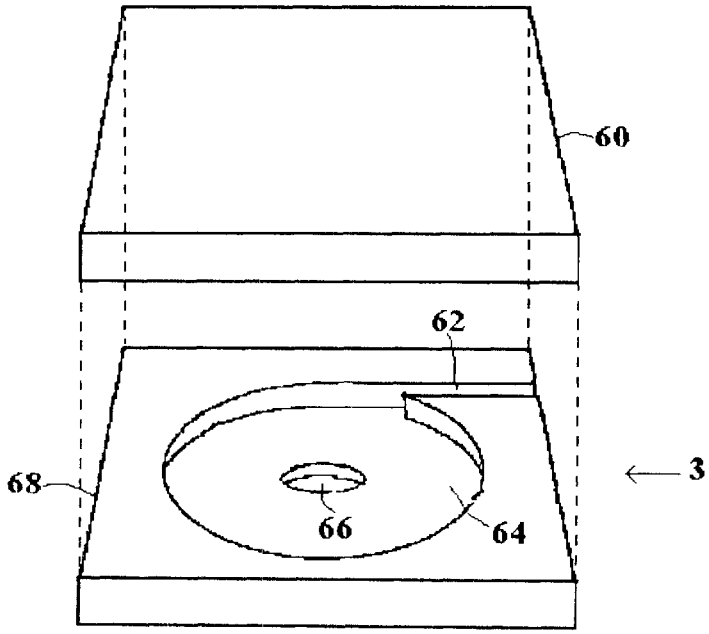
Fig. 3 Prior Art
FIG. 3 is an exploded perspective view of a prior art vortex diode.

FIG. 3 is a, perspective, blow-up view of a prior art vortex diode 3. As shown, the diode is formed by connecting cover plate 60 to base 68, thereby creating a block with two external openings to race 64: tangential passage 62 and axial passage 66. Diode 3 impedes flows through it in both directions, but fluid flows through diode 3 more readily when entering axial passage 66 and exiting through tangential passage 62 than when flowing in the opposite direction.

FIGS. 4A, 4B—PREFERRED EMBODIMENT

Figure 4A:
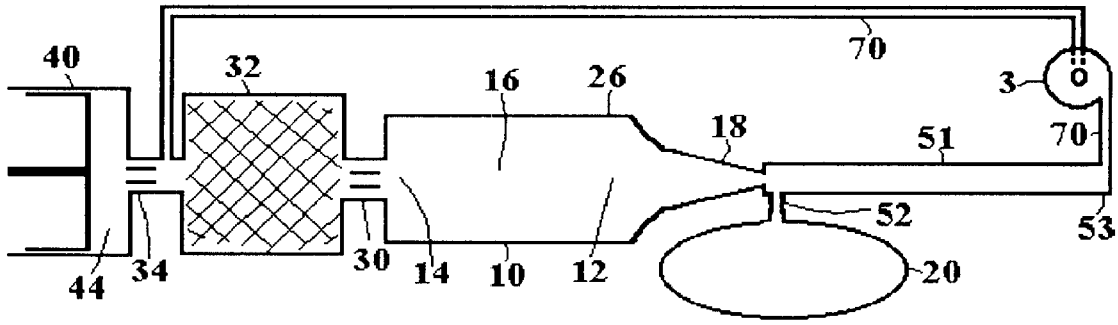
FIG. 4A is a schematic representation of a pulse tube refrigerator of this invention.

FIG. 4A is a schematic view of a preferred embodiment of a pulse tube refrigerator of this invention. It is similar to the pulse tube refrigerator of FIG. 2 except that remote end 53 of vortex tube 51 is connected to double inlet passage 70; diode 3 is interposed in double inlet passage 70; and the other end of double inlet passage 70 is connected between aftercooler 34 and regenerator 32.

Figure 4B:
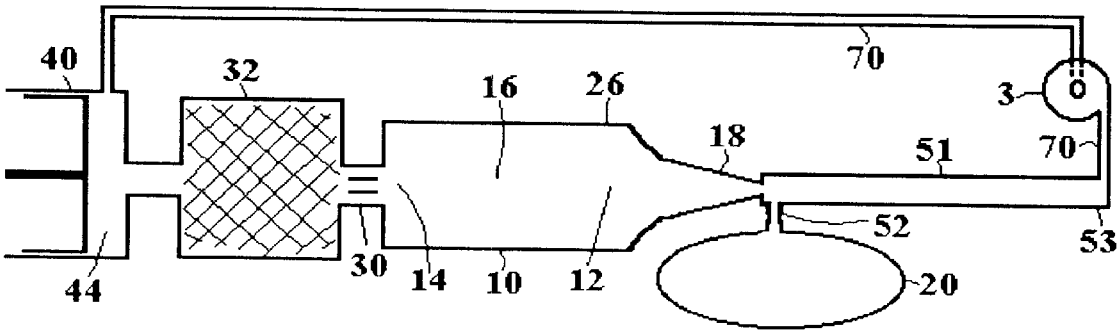
FIG. 4B is a schematic representation of an alternate embodiment of a pulse tube refrigerator of this invention.

FIG. 4B is a schematic view of an alternate preferred embodiment of a pulse tube refrigerator of this invention. It differs from the embodiment shown in FIG. 4A in that there is no aftercooler, and double inlet passage 70 is connected directly to compressor 40.

FIGS. 5A, 5B—PRIOR ART

Figure 5A:
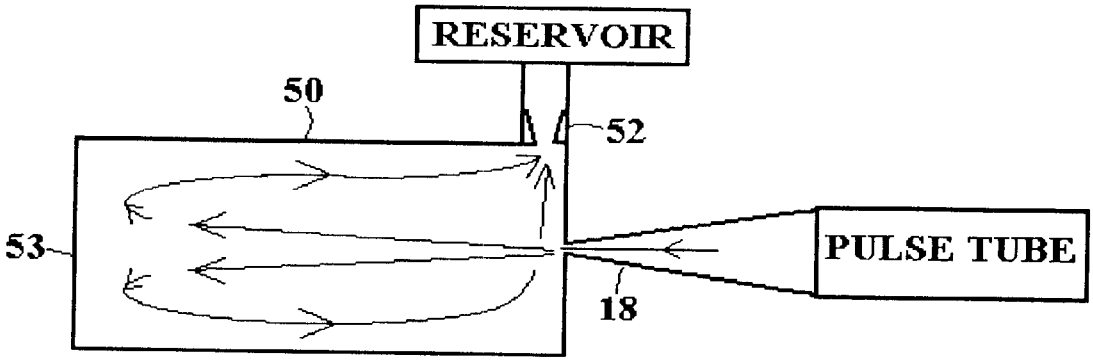
Fig. 5A Prior Art
FIG. 5A is a schematic illustration of flow from pulse tube through blind vortex tube to reservoir in a prior-art pulse tube refrigerator with a blind vortex tube heat exchanger.

FIG. 5A is a schematic representation of flows in blind vortex tube 50 of FIG. 2 as fluid enters blind vortex tube 50 through cold throat 18 and exits blind vortex tube 50 through vortex generator 52. Vortex generator 52 comprises one or more passages that enter blind vortex tube 50 tangentially and immediately adjacent to cold throat 18.

Figure 5B:
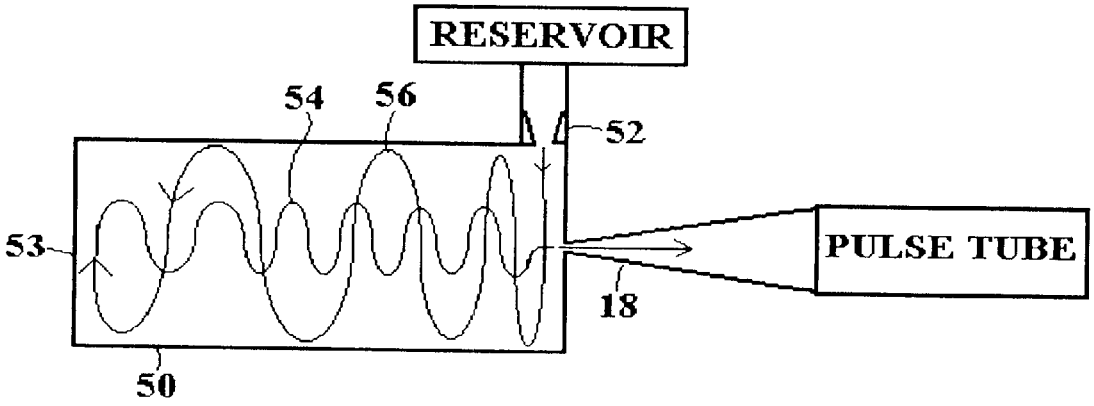
Fig. 5B Prior Art
FIG. 5B is a schematic illustration of flow from reservoir through blind vortex tube to pulse tube in a prior-art pulse tube refrigerator with a blind vortex tube heat exchanger.

FIG. 5B is a schematic representation of flows in blind vortex tube 50 of FIG. 2 as fluid enters blind vortex tube 50 through vortex generator 52 and exits blind vortex tube 50 through cold throat 18. An outer rotating shell of fluid 56, moving from vortex generator toward remote end 53, surrounds inner rotating core of fluid 54, which moves fluid from remote end 53 to cold throat 18.

Proportions of vortex tube 51 are grossly exaggerated to make room for the arrows and streamlines showing flow patterns; actual ratios of length over diameter are much larger

FIGS. 6A, 6B, 6C, 6D

FIGS. 6A, 6B, 6C and 6D schematically illustrate flows in the vortex tube of a preferred embodiment of this invention at different moments during a pressure cycle. Vortex tube 51 is connected to the compressor through double inlet passage 70, which is constricted by diode 3. vortex Flows into and out of vortex tube 51 are governed by pressure differences between vortex tube 51 and the compressor, reservoir and pulse tube, respectively. Diode 3, vortex generator 52 and cold throat 18 restrict those flows. Streamlines and arrows indicate fluid flows. Proportions of vortex tube 51 are grossly exaggerated to make room for the arrows and streamlines; preferred ratios of length over diameter are much larger, of the order of 15:1 and greater. In a preferred embodiment as tested, the ratio was about 16:1.

Figure 6A:
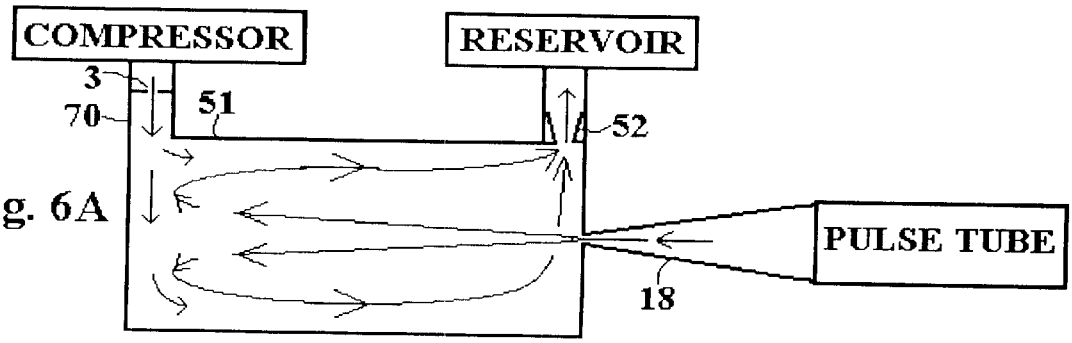
FIG. 6A is a schematic illustration of flows in the vortex tube of this invention with pressure in the vortex tube high and rising.

FIG. 6A is a schematic representation of flows in vortex tube 51 with pressure in the compressor and the pulse tube greater than pressure in vortex tube 51 and pressure in vortex tube 51 greater than pressure in the reservoir.

Figure 6B:
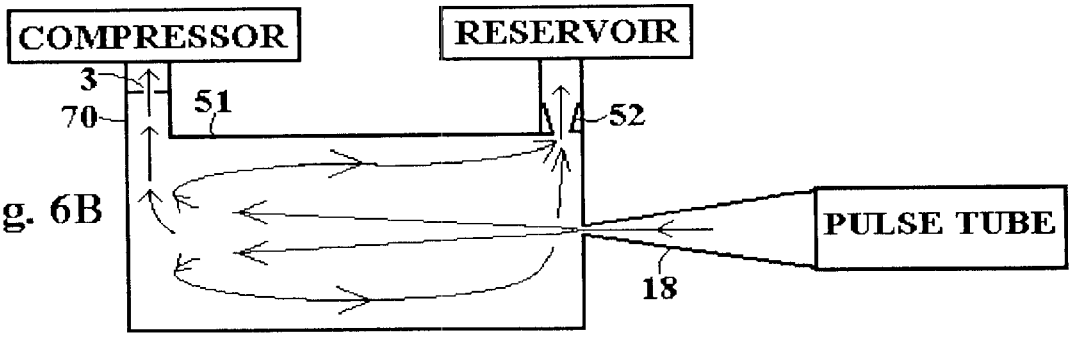
FIG. 6B is a schematic illustration of flows in the vortex tube of this invention with pressure in the vortex tube high and falling.

FIG. 6B is a schematic representation of flows in vortex tube 51 with pressure in the compressor lower than pressure in vortex tube 51, pressure in the pulse tube greater than pressure in vortex tube 51 and pressure in vortex tube 51 greater than pressure in the reservoir.

Figure 6C:
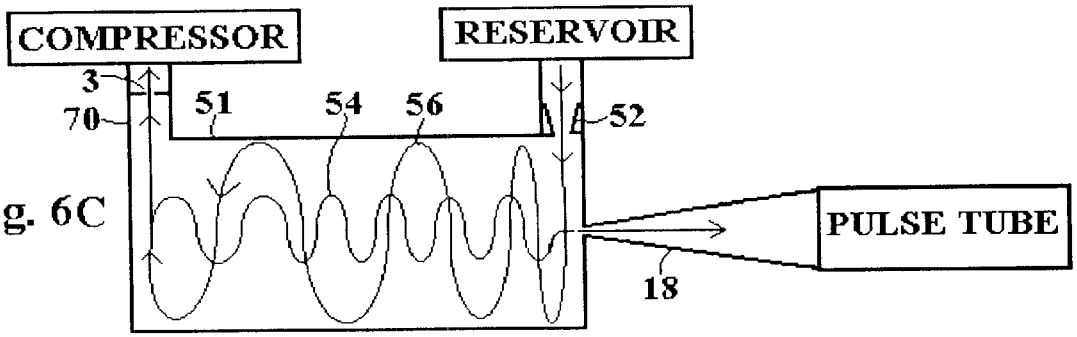
FIG. 6C is a schematic illustration of flows in the vortex tube of this invention with pressure in the vortex tube low and falling.

FIG. 6C is a schematic representation of flows in vortex tube 51 with pressure in the compressor and the pulse tube lower than pressure in vortex tube 51, and pressure in the reservoir greater than pressure in vortex tube 51.

Figure 6D:
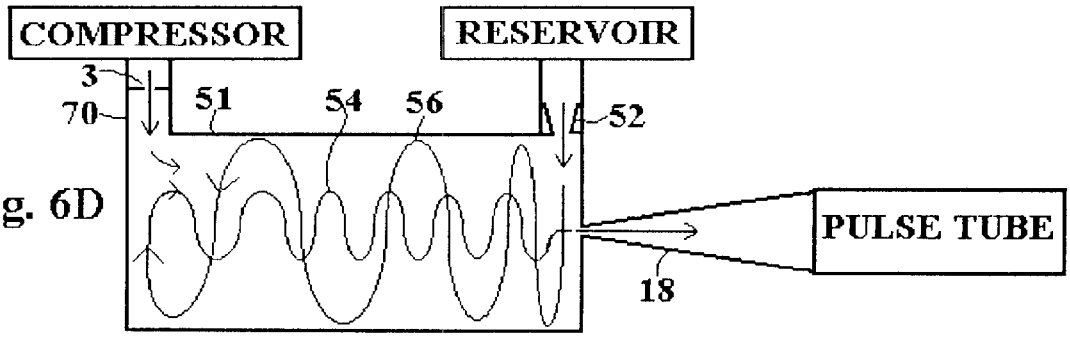
FIG. 6D is a schematic illustration of flows in the vortex tube of this invention with pressure in the vortex tube low and rising.

FIG. 6D is a schematic representation of flows in vortex tube 51 with pressure in the compressor and the reservoir greater than pressure in vortex tube 51 and pressure in vortex tube 51 greater than pressure in the pulse tube.

OPERATION—FIGS. 4A, 4B, 6A, 6B, 6C, 6D

Description and operation, FIGS. 4A, 4B:

The invention is shown schematically in FIGS. 4A, 4B. Instead of a warm heat exchanger and an orifice, the invention uses a vortex tube and its associated cold throat and vortex generator as both heat exchanger and orifice. Remote end 53 of vortex tube 51 is connected to compressor 40 through double inlet passage 70 in the embodiments shown both FIGS. 4A and 4B. Although the connection of one end of double inlet passage 70 differs between FIGS. 4A and 4B, their operation is essentially the same. Pressure in compression space 44 fluctuates, driving both flows and pressure changes throughout the other spaces to which it is connected. Rising pressure in pulse tube 10 raises the temperature of all fluid in pulse tube 10. Decreasing pressure in pulse tube 10 decreases the temperature of all fluid in pulse tube 10. Cooling is accomplished by moving some cold fluid 14 in pulse tube 10 through cold heat exchanger 30 while cold fluid 14 is coldest and moving some warm fluid 12 through cold throat 18 into vortex tube 51 when it is warmest. The amount of cooling obtainable in cold heat exchanger 30 is directly determined by the amount of heat rejected from fluid that exits and enters pulse tube 10 through cold throat 18.

The purpose of vortex tube 51 is to reject heat in warm fluid 12 that moves between pulse tube 10 and vortex tube 51 over the course of a pressure cycle. With blind vortex tube 50, shown in FIGS. 2, SA and 5B (all prior art), there is no double inlet passage and all of that heat must be rejected through the wall of blind vortex tube 50. With the end of vortex tube 51 connected to compressor 40 through double inlet passage 70, as shown in FIGS. 4*a* and 4B, fluid flows from remote end 53 of vortex tube 51 to compressor 40 when pressure in compression space 44 is lower than pressure in vortex tube 51. As pressure in vortex tube 51 drops below pressure in reservoir 20, fluid begins to flow from reservoir 20 to vortex tube 51 through vortex generator 52, creating the vortex effect that heats outer rotating shell of fluid 56 as shown in FIGS. 6C and 6D. Some of that hot fluid exits from remote end 53 of vortex tube 51, carrying with it heat that is eventually rejected in aftercooler 34 in FIG. 4A or in compressor 40 in FIG. 4B. That heat-removal effect supplements heat-removal by conduction to the wall of vortex tube 51. In essence, for the portion of the cycle in which pressure in vortex tube 51 is lower than reservoir pressure and falling, vortex tube 51 acts like a conventional Ranque/Hilsch vortex tube, with fluid exiting from both ends, hot through remote end 53 and cold through cold throat 18.

Pressures in compression space 44 and the other components with which compressor 40 is in fluid communication fluctuate at the same frequency, but not in the same phase. Flows between compressor 40 and the other components with which compressor 40 is in fluid communication likewise fluctuate at the same frequency, but not in the same phase. The phase difference between pressure in compression space 44 and pressure in reservoir 20 is particularly large. Volumetric flows into and out of reservoir 20 are limited to a small fraction of the volume of reservoir 20 and pressure in reservoir 20 therefore fluctuates little compared to pressure in compression space 44, pulse tube 10 or double inlet passage 70. Pressure in reservoir 20 continues to rise as long as pressure in vortex tube 51 is higher than pressure in reservoir 20, and thus does not peak until well after pressure in vortex tube 51 has peaked and is falling. The distribution of pressures and the corresponding effect on flow is illustrated in FIGS. 6A, 6B, 6C, and 6D.

DESCRIPTION AND OPERATIONS, FIGS. 6A, 6B, 6C, 6D:

FIGS. 6A, 6B, 6C, and 6D illustrate fluid flows in the vortex tube of this invention at sequential moments during the course of a cycle of pressure changes in the fluid contained in the refrigerator. Pressure in vortex tube 51 is described as "high" or "low" relative to pressure in reservoir 20.

FIG. 6A illustrates flows while pressure in vortex tube 51 is high and rising. During that portion of the cycle, fluid enters vortex tube 51 through both double inlet passage 70 and cold throat 18. Fluid leaves vortex tube 51 through vortex generator 52. During that part of the cycle, fluid entering vortex tube 51 through cold throat 18 is hot, and it rejects heat to the cooler wall of vortex tube 51. That wall, in turn, is cooled by any convenient means such as external fins, a fan, or a water jacket (not shown).

FIG. 6B illustrates flows while pressure in vortex tube 51 is high but falling. During that portion of the cycle, fluid leaves vortex tube 51 through both double inlet passage 70 and vortex generator 52. Some fluid continues to be drawn into vortex tube 51 as pressure in vortex tube 51 momentarily falls below that in the pulse tube, as the pressure changes in the pulse tube lag pressure changes in double inlet passage 70.

FIG. 6C illustrates flows while pressure in vortex tube 51 is low and falling. During that portion of the cycle, fluid leaves vortex tube 51 through both double inlet passage 70 and cold throat 18. Fluid enters vortex tube 51 through vortex generator 52. During that portion of the cycle, vortex tube 51 operates in the familiar manner of commercial Ranque/Hilsch vortex tubes, with outer rotating shell of fluid 56 becoming hot and inner rotating core of fluid 54 being cooled to a temperature below that of the wall of vortex tube 51. Some of the heat in outer rotating shell of fluid 56 is rejected by conduction to the wall of vortex tube 51. A portion of the fluid in the outer rotating shell of fluid 56 exits through double inlet passage 70, carrying with it additional heat.

FIG. 6D illustrates flows while pressure in vortex tube 51 is low and rising. Fluid enters vortex tube 51 through double inlet passage 70 and through vortex generator 52 but exits through cold throat 18. Because the phase of pressure in pulse tube 10 lags pressure in double inlet passage 70, pressure in double inlet passage 70 is above pressure in vortex tube 51 while pressure in cold throat 18 is still below pressure in vortex tube 51. Because fluid is still entering vortex tube 51 through vortex generator 52, a vortex effect continues to enhance heat rejection, but now only to the extent shown in FIG. 5B, prior art.

A refrigerator embodying this invention is optimized by adjusting the speed of operation and the relative sizes of cold throat 18, vortex generator 52, double inlet passage 70 and diode 30 relative to each other. Those dimensions are adjusted to produce a volumetric flow of fluid back and forth through cold throat 18 equivalent to a fraction of the volume of pulse tube 10 and volumetric flow back and forth through vortex generator 52 that is greater than the total volume of pulse tube 10.

In experimental work, temperature spreads of more than 230 Kelvins have been obtained with a pulse tube volume of about 28 cc, and flows to and from a 500 cc reservoir of about 33.7 to 63.5 cc, depending upon the dimensions of diodes and vortex generators employed.

The surprising result of this invention is that more heat can be rejected than would be possible using either the traditional heat exchanger of prior art pulse tube refrigerators as shown in FIG. 1 or with prior art blind vortex tubes tube heat exchangers as shown in FIGS. 2, 5A and 5B. Since the heat that can be lifted at the cold heat exchanger is directly determined by the amount of heat that can be rejected at the warm heat exchanger, this invention improves cooling power of pulse tube refrigerators.

CONCLUSION, RAMIFICATIONS, AND SCOPE

An orifice pulse tube refrigerator that employs a vortex tube as its heat-rejecting heat exchanger at the warm end of the pulse tube is simple, sturdy and reliable. A vortex tube has unique and advantageous properties as a heat rejecting heat exchanger, since it is effective with flow through it in both directions, and is not regenerative. Moreover, the vortex tube serves not only as heat-rejecting heat exchanger but also as impedance, thus serving a double purpose. However, without ancillary arrangements for modifying the phase relationship between pressure and flow, and for exhausting hot fluid from its blind end, a refrigerator equipped with a blind vortex tube does not reach its maximum potential. With the double inlet connection of this invention, that potential can be realized.

While I believe that the representation of fluid flows shown in FIGS. 5A, 5B, 6A, 6B, 6C and 6D are accurate, those flows have not been, probably cannot be, observed directly. They are inferred from measurements of the timing of pressure changes in a vortex tube heat exchanger, reservoir, and compressor of this invention, from perusal of prior art literature and from observation of the heat-rejecting behavior of Ranque/Hilsch and blind vortex tubes in steady flow and reversing flow.

While the description of the preferred embodiments in FIGS. 4A and 4B illustrate a compressor that is directly connected to the refrigerator, valved compressors known to the art are equivalent. While the description of the preferred embodiments in FIGS. 4A and 4B illustrate a vortex diode 3 as the device used to control flow in double inlet passage 70, other equivalent fluidic devices known to the art can be used. While reservoir 20 is shown in FIGS. 4A and 4B as closely connected to vortex generator 52, the connection may also be elongated to form an "inertance tube" known to the art.

Thus the scope of the invention should be determined by the appended claims and their legal equivalents, rather than by the examples given.

I claim:

1. In an orifice pulse tube refrigerator, an improvement comprising:

compressor means;

regenerator means having a first end and a second end, with said first end of said regenerator means connected to said compressor means;

cold heat exchanger means having a first end and a second end, with said first end of said cold heat exchanger means connected to said second end of said regenerator means;

pulse tube means having a first end and a second end, with said first end of said pulse tube means connected to said second end of said cold heat exchanger means;

a cold throat having a large end and a small end, with said large end of said cold throat connected to said second end of said pulse tube;

a vortex tube having a first end and a second end, with said first end of said vortex tube connected to said small end of said cold throat;

vortex generator means connected to said vortex tube adjacent to said first end of said vortex tube;

reservoir means connected to said vortex tube through said vortex generator means; and double inlet passage means having a first end and a second end, with said first end of said double inlet passage means connected to said second end of said vortex tube and said second end of said double inlet passage means connected to said compressor.

2. The improvement of claim 1 wherein said double inlet passage means contains means for limiting DC flow through said double inlet passage means.

3. The improvement of claim 2 wherein said means for limiting said DC flow comprises a vortex diode.

4. In an orifice pulse tube refrigerator, an improvement comprising:

compressor means;

regenerator means having a first end and a second end;

double inlet passage means having a first end and a second end;

aftercooler means having a first end and a second end, with said first end of said aftercooler means connected to said compressor means and with said second end of said aftercooler means connected to said first end of said regenerator means and to said second end of said double inlet passage means;

cold heat exchanger means having a first end and a second end, with said first end of said cold heat exchanger means connected to said second end of said regenerator means;

pulse tube means having a first end and a second end, with said first end of said pulse tube means connected to said second end of said cold heat exchanger means;

a cold throat having a large end and a small end, with said large end of said cold throat connected to said second end of said pulse tube means;

a vortex tube having a first end and a second end, with said first end of said vortex tube connected to said small end of said cold throat and with said second end of said vortex tube connected to said first end of said double inlet passage means;

vortex generator means connected to said vortex tube adjacent to said first end of said vortex tube;

reservoir means connected to said first end of said vortex tube through said vortex generator means; and having said first end of said double inlet passage means connected to said second end of said vortex tube.

5. The improvement of claim 4 wherein said double inlet passage contains means for limiting said DC flow through said double inlet passage means.

6. The improvement of claim 5 wherein said means for limiting said DC flow between said vortex tube and said compressor means comprises a vortex diode.

* * * * *